US009428000B1

(12) United States Patent
Koeppel et al.

(10) Patent No.: US 9,428,000 B1
(45) Date of Patent: Aug. 30, 2016

(54) SCRAPBOOK AND/OR PHOTO ALBUM SYSTEM WITH REPLACEABLE UNITARY MULTI-DISK SPINE

(71) Applicant: Continental Accessory Corporation, Amityville, NY (US)

(72) Inventors: Ronald Koeppel, Brookville, NY (US); Richard P. Koeppel, Brookville, NY (US)

(73) Assignee: Continental Accessory Corporation, Amityville, NY (US)

( * ) Notice: Subject to any disclaimer, the term of this patent is extended or adjusted under 35 U.S.C. 154(b) by 0 days.

(21) Appl. No.: 15/148,076

(22) Filed: May 6, 2016

(51) Int. Cl.

| | |
|---|---|
| ***B42F 3/00*** | (2006.01) |
| ***B42F 3/04*** | (2006.01) |
| ***B42F 5/00*** | (2006.01) |
| ***B42F 13/00*** | (2006.01) |

(52) U.S. Cl.
CPC ..... *B42F 5/00* (2013.01); *B42F 3/003* (2013.01); *B42F 3/04* (2013.01); *B42F 13/0066* (2013.01); *B42F 13/0073* (2013.01)

(58) Field of Classification Search
CPC ..... B42F 3/003; B42F 3/04; B42F 13/0066; B42F 13/0073
USPC ..... 402/24, 75, 501
See application file for complete search history.

(56) References Cited

U.S. PATENT DOCUMENTS

| | | | | | |
|---|---|---|---|---|---|
| 484,349 | A | * | 10/1892 | Waide | B42F 13/0066 402/501 |
| 1,027,523 | A | * | 5/1912 | Buchan | B42F 13/04 402/501 |
| 5,015,114 | A | * | 5/1991 | Miller | B42F 3/04 402/501 |
| 5,553,959 | A | | 9/1996 | Feldman et al. | |
| 5,749,667 | A | | 5/1998 | Feldman et al. | |
| 5,888,011 | A | * | 3/1999 | Reinbold, Jr. | B42F 13/00 402/24 |

FOREIGN PATENT DOCUMENTS

| | | | | | |
|---|---|---|---|---|---|
| CH | WO 9826941 | A1 | * | 6/1998 | B42F 3/003 |
| FR | 1008712 | A | * | 5/1952 | B42F 3/003 |

* cited by examiner

*Primary Examiner* — Kyle Grabowski
(74) *Attorney, Agent, or Firm* — Caesar Rivise, PC

(57) ABSTRACT

A scrapbook and/or photo album system is disclosed. The system includes a top cover panel, a bottom cover panel, a stack of plural pages, a replaceable spine and plural fasteners. The spine is a unitary member made up of a plurality of disks fixedly secured together by a common rod. Each of the pages has an inner edge including a plurality of generally mushroom shaped slots. Each of the disks is circular and has a generally planar central section and an enlarged peripheral rim shaped to mate with and be received in a respective one of the slots of the page to secure each page to the spine. The common rod of the spin includes plural hollow portions, each configured to receive a respective fastener to secure the cover panels to the spine.

20 Claims, 4 Drawing Sheets

SCRAPBOOK AND/OR PHOTO ALBUM SYSTEM WITH REPLACEABLE UNITARY MULTI-DISK SPINE

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

FIELD OF THE INVENTION

This invention relates generally to scrapbook systems and photo albums and more particularly to scrapbook systems and photo album systems made up of a cover, removable pages and a unitary spine made up of plural disks to releasably secure pages together to the cover, and which spine can be replaced if desired.

BACKGROUND OF THE INVENTION

Notebook systems making use of a stack of sheets is bound together using a plurality of disks are commercially available from various sources, including Continental Accessory, Corp., the assignee of the subject invention. Those notebook systems include a front cover, a rear cover, a plurality of disks and a stack of sheets, e.g., paper sheets. Each of the sheets and the covers include a plurality of mushroom-like shaped slots along one marginal edge thereof. Each of the slots is arranged to receive a respective disk to bind all of the sheets and covers together, so that the notebook serves as a binder with removable sheets.

U.S. Pat. No. 5,553,959 (Feldman et al.) and U.S. Pat. No. 5,749,667 (Feldman et al.) disclose notebook systems like the foregoing. In particular, the Feldman et al. systems make use of a stack of sheets is bound together between a front and rear cover using a plurality of disks that are inserted into mushroom shaped slots in the edge of each of the sheets of the stack and each of the covers. Each of the plural disks has a substantially flat disk-like central surface portion and an enlarged continuous rim portion which extends around the periphery of the central surface portion. The rim portion extends outwardly in a direction perpendicular to the flat central portions of the disks, and the central surface portion has a radius which is larger than the thickness of a stack of sheets to be bound thereby.

While such prior art notebook systems are generally suitable for their intended purposes, they leave much to be desired from the standpoint of each assembly of the notebook, each of use, and ability to be configured to accommodate more than a prescribed number of pages, due to the fixed size of the disks. Thus, a need exists for a notebook or scrapbook system or photo album system which overcomes those drawbacks. The subject invention addresses that need.

All references cited and/or identified herein are specifically incorporated by reference herein.

SUMMARY OF THE INVENTION

In accordance with one aspect of this invention a scrapbook and/or photo album system is provided. The system comprises a cover including a top cover panel and a bottom cover panel, a plurality of pages, a plurality of fasteners, and a unitary spine. The spine comprises a plurality of disks, each of the disks being of circular profile and having a generally planar central section and an enlarged peripheral rim. Each of the disks is fixedly secured to each other by a common rod joined to each central section of each disk. The common rod includes plural connector portions. Each of the connector portions is configured for releasable securement to a respective one of the fasteners. Each of the covers includes an edge portion having plural apertures therein, with respective ones of the fasteners extending through respective ones of the apertures for releasable securement to respective ones of the connector portions of the spine to releasably secure the cover to the spine. Each of the pages comprises a web of material having an inner edge portion including an inner edge and a plurality of slots spaced along the inner edge. Each of the slots comprises an entryway channel extending inward from the inner edge and terminating at an enlarged opening for receipt of a respective one of the disks to releasably secure the page to the spine.

In accordance with one preferred aspect of this invention each of the edge portions of the covers comprises a first portion folded under a contiguous portion of the cover, with the first portion of the cover including the apertures therein.

In accordance with another preferred aspect of this invention each of the edge portions of each of the cover panels comprises a foldable portion configured to be folded from the remainder of the cover panel, with the foldable portion having the apertures therein.

In accordance with another preferred aspect of this invention each of the connector portions projects outward from the common rod.

In accordance with another preferred aspect of this invention each of the fasteners is in the form of an elongated body having an enlarged head.

In accordance with another preferred aspect of this invention the cover additionally comprises a spine cover panel configured to be connected between the top cover panel and the bottom cover panel to enclose a portion of the spine.

In accordance with another preferred aspect of this invention at least one of the plurality of pages includes a pocket therein.

In accordance with another preferred aspect of this invention the pages are reinforced at the location of the slots.

DETAILED DESCRIPTION OF THE PREFERRED EMBODIMENT

Figure 1:
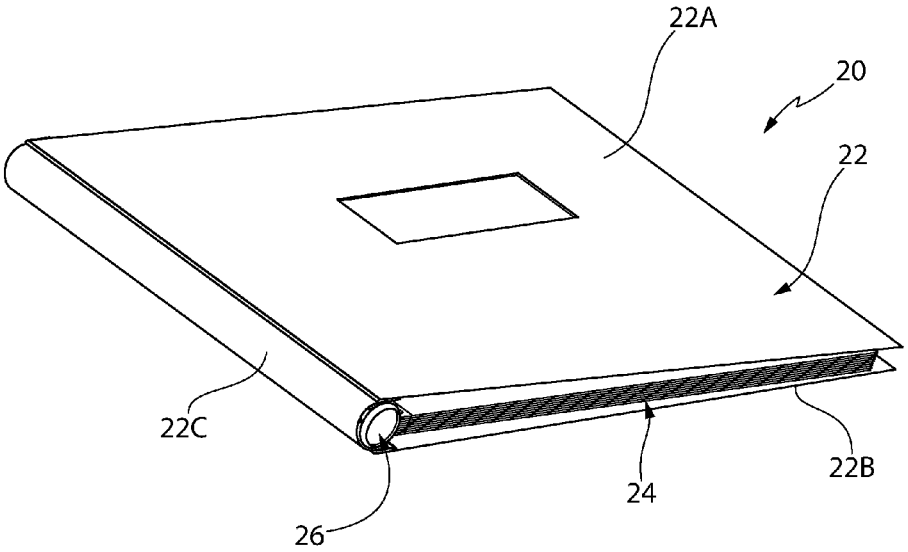
FIG. 1 is an isometric view of one exemplary embodiment of a scrapbook and/or photo album system constructed in accordance with this invention.
Figure 2:
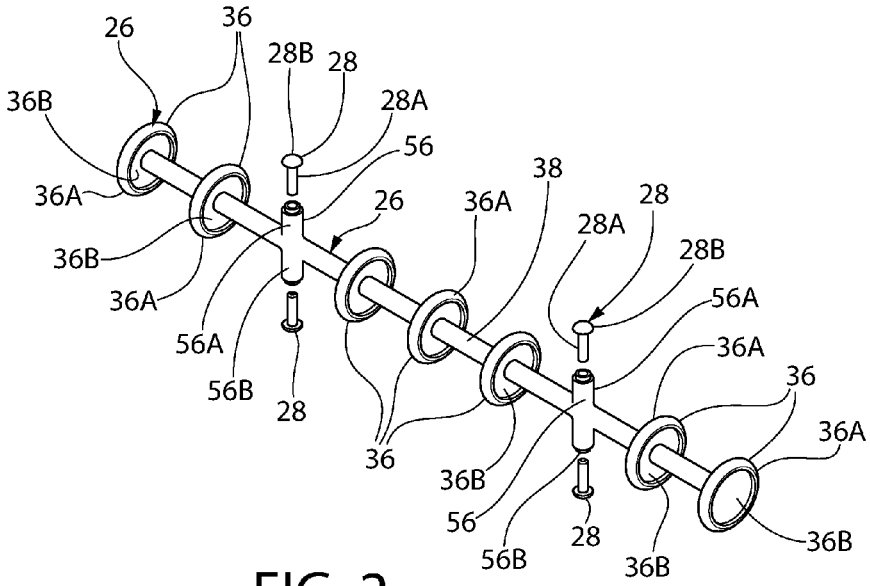
FIG. 2 is an enlarged exploded isometric view of a unitary spine and plural fasteners forming a portion of the system of FIG. 1.

Referring now to the various figures of the drawing wherein like reference characters refer to like parts, there is shown at 20 in FIG. 1 one exemplary embodiment of a scrapbook and/or photo album system constructed in accordance with this invention. The system includes a cover 22, a plurality of pages 24, a spine 26, and plural fasteners 28 (FIG. 2).

Figure 3:
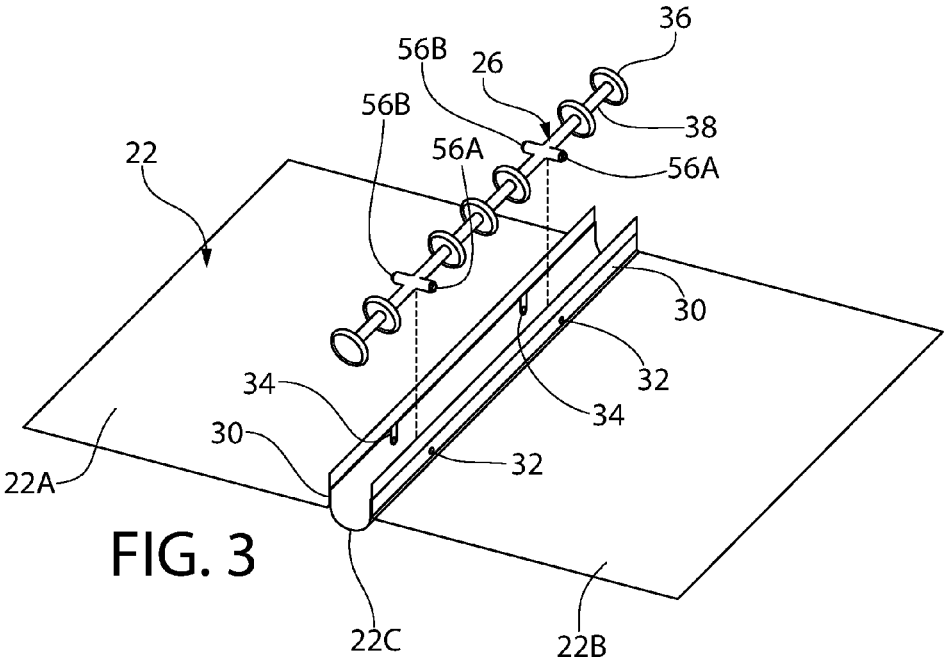
FIG. 3 is an exploded isometric view showing an initial step in the assembly of the system of FIG. 1.

The cover 22 is best seen in FIGS. 1 and 3 and basically a top cover panel 22A, a bottom cover panel 22B, and a spine cover panel 22C. Each of those components is a separate member. In particular, the top and bottom cover panels are each planar members formed of any suitable material, e.g., cardboard, leather (real or faux), polypropylene, other plastics, etc. and any combination(s) thereof. The panels 22A and 22B are typically of rectangular shape, but may be of square shape, or any other regular or irregular shape. In the exemplary embodiment shown the panels are of rectangular shape. Each of the top and bottom panels includes an inner edge portion 30, which as can be seen in FIG. 3 is foldable so that it can be folded upward from the plane of the panel to which it is a part. Each foldable portion 30 includes plural holes 32 for receipt of respective ones of the fasteners 28 to secure the cover panels to the spine, as will be described later.

Figure 4:
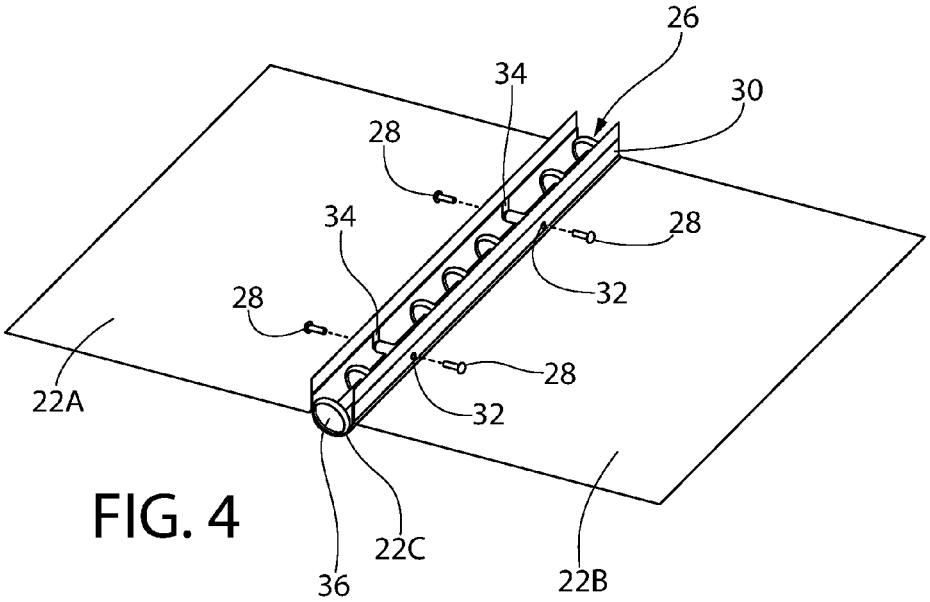
FIG. 4 is an isometric view, similar to FIG. 3, but showing a later step in the assembly of the system of FIG. 1.

The spine cover panel 22C is a narrow web of relatively flexible material which is preferably of the same material as the front and rear covers panels, to provide the same visual appearance. The spine cover panel 22C is considerably thinner than the top and bottom cover panels 22A and 22B, respectively, in the interest of flexibility to enable it to be curved around the spine 26 between the top and bottom cover panels, as will be described later. Moreover, as best seen in FIGS. 3 and 4, each of the side edges of the spine cover panel 22C include a pair of U-shaped slots 34. The slots are provided to receive portions of respective fasteners 28 when those fasteners are used to secure the top and bottom cover panels to the spine, with the spine cover panel 22C interposed therebetween.

Each of the fasteners 28 is an elongated member having a rod-like body section 28A and an enlarged head 28B. In the exemplary embodiment shown, each fastener is in the form of a rivet. That is merely exemplary and other types of fasteners are contemplated in accordance with this invention. Thus, for example each fastener 28 may be in the form of a screw having external threads on the body section 28A and one or more slots in the head 28B.

The details of the spine 26 will be described later. Suffice it for now to state that the spine 26 is a unitary member, formed of any suitable material, e.g., a strong plastic, metal, etc., and is made up of a plurality of disks 36 (FIG. 2). The disks 36 are secured to each other by a common central bar or rod 38. Each disk is shaped to be received within a correspondingly shaped slot (to be described later) in the edge of each page 24.

Figure 7:
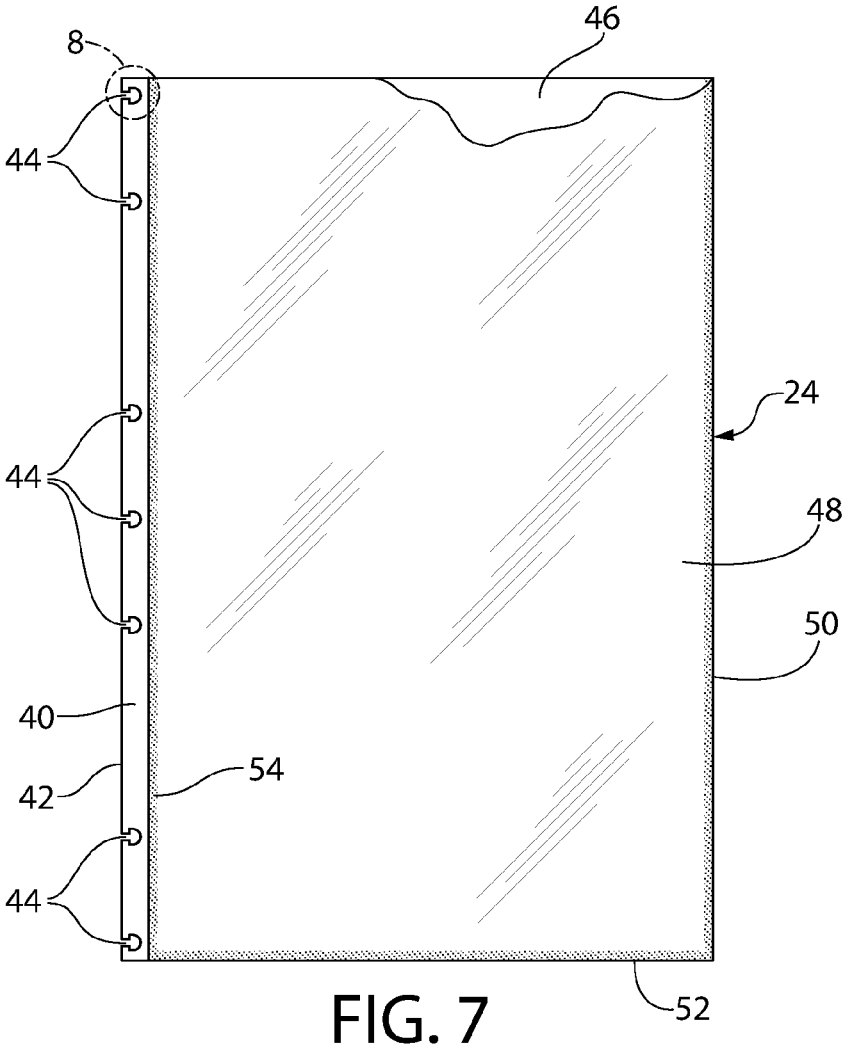
FIG. 7 is an enlarged plan view, partially broken away, of one exemplary page used in the system of FIG. 1.
Figure 8:
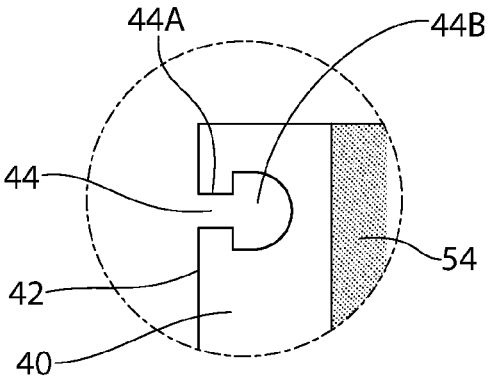
FIG. 8 is an enlarged view of the portion of the page shown within the broken line circle designated as "8" in FIG. 7.

The pages 24 are preferably constructed in accordance with the teachings of co-pending U.S. patent application Ser. No. 14/833,443, filed on Aug. 24, 2015, entitled Disk-Bound Notebook System With Sheets And Sheets Therefor, which is assigned to the same assignee as this invention and whose disclosure is incorporated by reference herein. Thus, as can be seen in FIG. 7, each of the pages 24 has an inner edge portion 40, including an inner edge 42 and a plurality of slots 44 spaced along the inner edge 42. Each of the slots includes an entryway channel 44A extending inward from the inner edge 42 and terminating at an enlarged opening 44B. The enlarged opening 44B is shaped somewhat like the crown of a mushroom with somewhat flattened side edges, as best seen in FIG. 8.

The inner edge portion 40 of each page is preferably reinforced by a reinforcing strip extending therealong. The reinforcement strip may be a thin layer of a plastic material, such as but not limited to a liquid lamination coating, a thin layer of Mylar, foil, paper, metal or fiberglass, which is fixedly secured to the upper surface of the page at the edge portion 40. Preferably the plastic material is transparent, but could be opaque and/or colored in the interest of aesthetics.

It should be noted that the foregoing arrangement of the reinforcing strip is merely exemplary. Thus, it is contemplated that the strip of reinforcement may be on the undersurface of the page or on both surfaces. Moreover, the reinforcing strip may be formed of other materials than the exemplary plastic material. In fact, if desired, each page may not be reinforced, if reinforcement isn't necessary or desired.

The pages 24 can be formed of any suitable material, e.g., paper, plastic, and combinations thereof. Moreover, each page may be a single layer or may be dual layered to form one or more pockets to accommodate keepsake items, e.g., photographs, tickets, autographs, etc., therein. In the exemplary embodiment shown in FIG. 7, the page 24 is of a dual layer construction having a bottom later 46 and a top layer 48, which are coextensive in size. The bottom and top layers 46 and 48 are sealed together by a seal line 50 alongside their outside edge, by a seal line 52 alongside their bottom edge, and by a seal line 54 adjacent the inner edge portion 40, thereby forming a pocket therebetween. The top edge portion of the top layer 48 and bottom layer 46 are not secured to each other to from a mouth for accessing the pocket.

If desired, the page may include indicia thereon, e.g., lines, etc., like that shown in the aforementioned U.S. patent application Ser. No. 14/833,443.

As mentioned above each of the disks 36 is arranged to be received in a respective slot 44 of a page 24. Thus, the disks 36 are circular in profile and are of a cross-section which is shaped to mate with the slots 44. In particular, the periphery of each disk comprises an enlarged continuous rim portion 36A extending around the entire periphery of the disk, with the rim portion having shape corresponding to the shape of the opening 44B of the slot 44. The central section 36B of each disk 36 is planar and is of a thickness slightly less than the width of the channel 44A of the slot 44 so that it can be received within the channel, when the rim 36A of the disk is within the associated enlarged opening 44B of the slot 44.

Turning back to FIG. 2 further details of the spine 26 will now be described. To that end, it can be seen that the spine includes plural, in this case two, arm-like projections 56 projecting perpendicularly to the central longitudinal axis of the central rod 38. Each projection 56 includes a first free end 56A and a second free end 56B. The free ends are axially aligned with each other and are hollow to receive respective ones of the fasteners 28 therein to secure the top, bottom and spine cover panels together.

Figure 5:
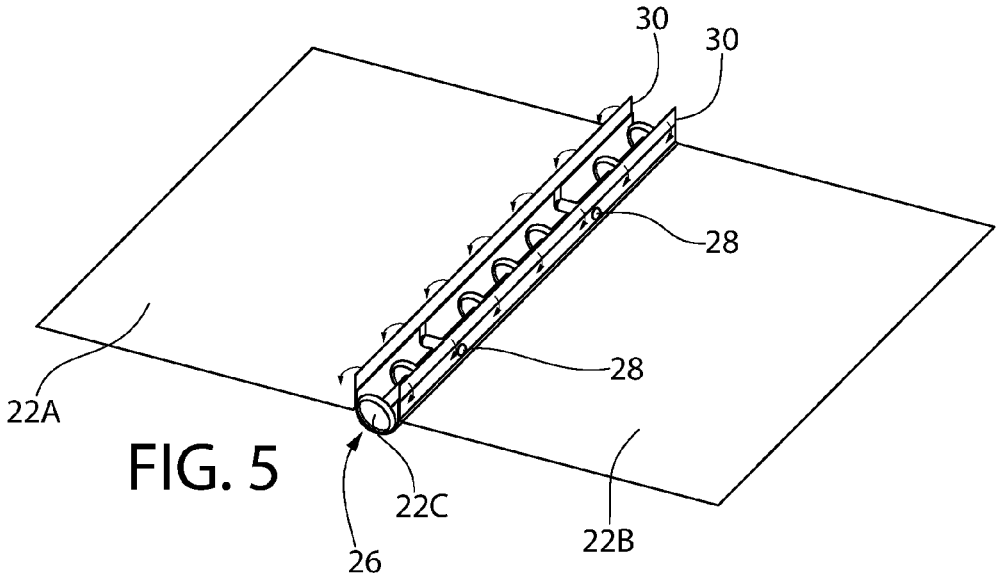
FIG. 5 is an isometric view, similar to FIGS. 3 and 4, but showing a later step in the assembly of the system of FIG. 1.
Figure 6:
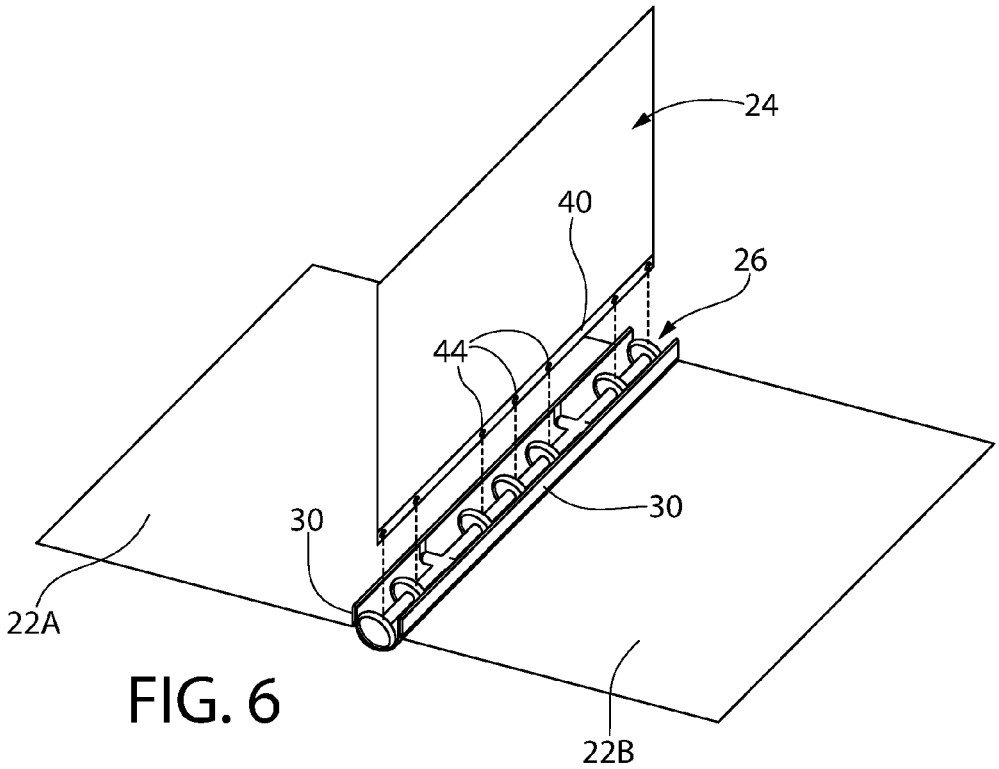
FIG. 6 is an isometric view, similar to FIGS. 3-5, but showing a later step in the assembly of the system of FIG. 1.

That action can be accomplished as follows and will best be appreciated by reference to FIGS. 3-6. For example the top and bottom cover panels 22A and 22B, respectively, can be juxtaposed so that they are side-by-side, with their respective panel portions 30 folded upward, like shown in FIG. 3. The spine cover panel 22C is interposed between the adjacent folded portions 30 of the panels 22A and 22B so that its U-shaped slots 34 are aligned with the openings 32 in the upwardly folded panel portions 30. The unitary spine 26 can then be oriented so that it is interposed within the bounds of the spine cover panel 22C between the folded panel portions 30, with the free ends 56A of the spine projections 56 aligned with the U-shaped slots 34 and the aligned openings 32 of the bottom cover panel 22B and with the free ends 56B of the spine projections 56 aligned with the U-shaped slots 34 and the aligned openings 32 of the top cover panel 22A. The fasteners 28, can then be extended through the aligned holes 32 and slots 34 into the associated hollow interiors of the free ends 56A and 56B of the spine's projections 56 until the head 28B of each fastener abuts the folded up portion 30 as shown in FIG. 5. At that time the edge portions of the portions 30 can then be folded downward in the direction of the curved arrows as shown in that figure, to thereby hide the heads of the fasteners.

The assembled cover panels and the spine form an assembly that is now ready to receive the pages 24. All that is required to complete the scrapbook is to insert the pages onto the disks, like shown in FIG. 6, whereupon a portion of the rim 36A of each disk 36 is releasably received within a corresponding slot 44 in the scrapbook page 24. The addition of any page into the scrapbook can be readily achieved in a similar manner. The removal of any page from the scrapbook is readily achieved by pulling on it to release the releasable securement of the page to the disks of the spine.

It should be pointed out at this juncture, that the scrapbook and/or photo album system may be provided with an auxiliary spine whose disks are larger in diameter than the disks of the initially provided spine. By so doing one can readily swap-out the smaller diameter disk spine for the larger diameter disk spine, to thereby provide a scrapbook/phot album with a larger page capacity. In fact, the system can be provided with various size spines so that the user can configure the scrapbook to accommodate whatever number of pages he/she wants. All that is required to swap out a one spine for another different size spine is to remove the fasteners to thereby disconnect the old spine from the cover. The pages can then be removed from the old spine, and the new spine assembled to the cover as described above. Once that has been accomplished the old pages can be connected to the disks of the new spine and additional or new pages added.

It should also be pointed out that many variations to the scrapbook and/or photo album system of this invention can be made within the scope of this invention. Thus, the spine may include any number of disks, and the spacing between the disks may be any spacing providing that the pages have slots to accommodate the spacing between the disks. Moreover, the number and location of the projections of the spine which are configured for receipt of the fasteners can be varied depending upon the application. Further still the projections may be constructed so that instead of being female members, e.g., hollow bodies to receive the fasteners (i.e., the male members), the projections may be male members, e.g., externally threaded projections or unthreaded rods, and the fasteners may be female members, e.g., internally threaded sockets or smooth walled sockets. Further still, while the spine is preferably a unitary member, e.g., molded as an integral unit, it may be formed of plural members that are securable to each other to form a unitary body. Further still, while the preferred exemplary embodiment shown makes use of a spine cover panel in the interest of aesthetics, the use of such a spine cover member is not mandatory. Further still the top and bottom cover panel need not include portions that fold over to hide the heads of the fasteners, if the aesthetics of such a construction is not desired.

Without further elaboration the foregoing will so fully illustrate our invention that others may, by applying current or future knowledge, adopt the same for use under various conditions of service.

We claim:

1. A scrapbook and/or photo album system comprising:

a cover including a top cover panel and a bottom cover panel, each of said cover panels including an edge portion having plural apertures therein;

a plurality of pages, each of said pages comprising a web of material having an inner edge portion including an inner edge and a plurality of slots spaced along said inner edge, each of said slots comprising an entryway channel extending inward from said inner edge and terminating at an enlarged opening;

a plurality of fasteners; and a unitary spine, said spine comprising a plurality of disks, each of said disks being of circular profile and having a generally planar central section and an enlarged peripheral rim, each of said disks being fixedly secured to each other by a common rod joined to each central section of each disk, said common rod including plural connector portions, each of said connector portions being configured for releasable securement to a respective one of said fasteners, with respective ones of said fasteners extending through respective ones of said apertures of said cover panels for releasable securement to respective ones of said connector portions of said spine to releasably secure said cover panels to said spine, with said peripheral rim of each of said disks being configured for receipt within a respective one of said slots in said page to releasably secure said page to said spine.

2. The system of claim 1 wherein each of said edge portions of each of said cover panels comprises a foldable portion configured to be folded from the remainder of the cover panel, said foldable portion having said apertures therein.

3. The system of claim 2 wherein each of said edge portions of each of said cover panels comprises a foldable portion configured to be folded from the remainder of the cover panel, said foldable portion having said apertures therein.

4. The system of claim 2 wherein each of said connector portions projects outward from said common rod.

5. The system of claim 2 wherein each of said fasteners is in the form of an elongated body having an enlarged head.

6. The system of claim 2 wherein said cover include a spine cover panel configured to be connected between said top cover and said bottom cover panel to enclose a portion of said spine.

7. The system of claim 2 wherein at least one of said plurality of pages include a pocket therein.

8. The system of claim 2 wherein said pages are reinforced at the location of said slots.

9. The system of claim 1 wherein each of said connector portions projects outward from said common rod.

10. The system of claim 9 wherein each of said fasteners is in the form of an elongated body having an enlarged head.

11. The system of claim 9 wherein said cover include a spine cover panel configured to be connected between said top cover panel and said bottom cover panel to enclose a portion of said spine.

12. The system of claim 9 wherein at least one of said plurality of pages include a pocket therein.

13. The system of claim 9 wherein said pages are reinforced at the location of said slots.

14. The system of claim 9 wherein each of said edge portions of each of said cover panels comprises a foldable portion configured to be folded from the remainder of the cover panel, said foldable portion having said apertures therein.

15. The system of claim 9 wherein each of said connector portions projects outward from said common rod.

16. The system of claim 9 wherein each of said fasteners is in the form of an elongated body having an enlarged head.

17. The system of claim 1 wherein each of said fasteners is in the form of an elongated body having an enlarged head.

18. The system of claim 1 wherein said cover includes a spine cover panel configured to be connected between said top cover panel and said bottom cover panel to enclose a portion of said spine.

19. The system of claim 1 wherein at least one of said plurality of pages includes a pocket therein.

20. The system of claim 1 wherein said pages are reinforced at the location of said slots.

* * * * *